United States Patent [19]

Garwood et al.

[11] Patent Number: 5,008,460

[45] Date of Patent: Apr. 16, 1991

[54] SYNTHETIC LUBRICANTS

[75] Inventors: William E. Garwood, Haddonfield; Quang N. Le, Cherry Hill; Joosup Shim, Wenonah; Stephen S. Wong, Medford, all of N.J.

[73] Assignee: Mobil Oil Corp., Fairfax, Va.

[21] Appl. No.: 358,108

[22] Filed: May 30, 1989

[51] Int. Cl.[5] ..... C07C 2/04

[52] U.S. Cl. ..... 585/11; 585/19; 585/24; 585/422; 585/446

[58] Field of Search ..... 585/422, 446, 435, 469, 585/323, 11, 19, 24

[56] References Cited

U.S. PATENT DOCUMENTS 3,594,320 7/1971 Orkin ..... 252/59

4,556,750 12/1985 Cobb ..... 585/446

4,618,737 10/1986 Chester et al. ..... 585/329

*Primary Examiner*—Asok Pal

*Attorney, Agent, or Firm*—Alexander J. McKillop; Charles J. Speciale; Dennis P. Santini

[57] ABSTRACT

Synthetic lubricating oils having a predetermined alkyl-aromatic structure are prepared from a mixture of mono- or dialkenyl benzene with an aliphatic olefin by free-radical reaction in the presence of ditertiary-butyl peroxide, for example. Equivalent napthalene derivatives may be substituted for the dialkenyl benzene. The oils that are formed exhibit a high Viscosity Index, and a low pour point. The viscosity of the synthetic lube stock produced may be controlled by changing the amount of peroxide used.

20 Claims, No Drawings

SYNTHETIC LUBRICANTS

FIELD OF THE INVENTION

This invention is concerned with synthetic lubricants. In particular, it is concerned with a process for forming a synthetic hydrocarbon lubricating oil base stock by peroxide-induced addition of aliphatic olefins with olefin-substituted aromatic hydrocarbons.

BACKGROUND OF THE INVENTION

Refining suitable petroleum crude oils to obtain a variety of lubricating oils which function effectively in diverse environments has become a highly developed and complex art. Although the broad principles involved in refining are qualitatively understood, there are quantitative uncertainties which require considerable resort to empiricism in practical refining. Underlying these quantitative uncertainties is the complexity of the molecular constitution of the precursor crude fractions. Because these crude fractions boil above about 550° F., the molecular weight of the constituents is high and these constituents display almost all conceivable structures and structure types including molecules that contain, in addition to carbon and hydrogen, metals, nitrogen, oxygen and sulfur, collectively referred to hereinbelow simply as "heteroatoms". This complexity and its consequences are referred to in "Petroleum Refinery Engineering", by W. L. Nelson, McGraw Hill Book Company, Inc., New York, N.Y. 1958 (Fourth Edition), relevant portions of this text being incorporated herein by reference for background.

The basic notion in lubricant refining is that a suitable crude oil, as shown by experience or by assay, contains a quantity of lubricant base stock oil having a predetermined set of properties such as, for example, appropriate viscosity, oxidation stability, and maintenance of fluidity at low temperatures. The process of refining to isolate that lubricant base stock currently consists of a set of subtractive unit operations which removes the unwanted components. The most important of these unit operations include distillation to recover one or more fractions boiling above about 600° F., solvent refining, and dewaxing, which basically are physical separation processes in the sense that if all the separated fractions were recombined one would reconstitute the crude oil.

Other processes such as hydrofinishing or clay percolation may be used if needed to reduce the nitrogen and sulfur content or improve the color of the lubricating oil stock.

A lubricant base stock, e.g. a refined petroleum oil or high boiling synthetic oils of this invention, may be used as such as a lubricant, or it may be blended with another lubricant base stock having somewhat different properties. Or, the base stock, prior to use as a lubricant, may be compounded with one or more additives which function, for example, as antioxidants, extreme pressure additives, and V.I. improves. As used herein, the term "base stock", regardless whether or not the term is further qualified, will refer only to a hydrocarbon oil without additives.

Viscosity Index (V.I.) is a quality parameter of considerable importance for lubricating oils to be used in automotive engines and aircraft engines which are subject to wide variations in temperature. This index is a series of numbers ranging from 0 to 100 which indicate the rate of change of viscosity with temperature. A Viscosity Index of 100 indicates an oil that does not tend to become viscous at low temperature or become thin at high temperatures. Measurement of the Saybolt Universal Viscosity of an oil at 100° and 210° F., and referral to correlations, provides a measure of the V.I. of the oil. For purposes of the present invention, whenever V.I. is referred to it is meant the V.I. as noted in the Viscosity Index tabulations of the ASTM(D567), published by ASTM, 1916 Race St., Philadelphia Pa., or equivalent.

To prepare high V.I. automotive and aircraft oils the refiner usually selects a crude oil relatively rich in paraffinic hydrocarbons, such oils being referred to commonly as "paraffin base" or "mixed base" crudes, since experience has shown that crudes poor in paraffins, such as those commonly termed "naphthene-base" crudes, yield little or no refined stock having a V.I. above about 40. (See Nelson, supra, pages 80–81 for classifications of crude oils). Suitable stocks for high V.I. oils, however, also contain substantial quantities of waxes which result in solvent-refined lubricating oil stocks of high pour point, i.e. a pour point greater than +25° F. Thus, in general, the refining of crude oil to prepare acceptable base stocks ordinarily includes dewaxing to reduce the pour point to a target value less than +25° F.

Factors which include the increasing shortage of high quality crudes suitable for lubricant production, the inherent limitations imposed by the complex, variable compositions of petroleum, and the increasing demand from engine manufacturers for lubes with exceptionally high V. I. and stability, have led refiners to seek synthetic oils suitable for use as lube base stock. Illustrative of materials that have been proposed are those described in U.S. Pat. No. 4,211,665 to Pellegrini et al., which describes the preparation of transformer oils by Friedel-Crafts condensation of benzene and decene oligomers; U.S. Pat. No. 4,604,491 to Dressler et al. which describes the preparation of synthetic oil by reacting alpha olefins with naphthalene over a heterogeneous acid catalyst; and U.S. Pat. No. 4,714,794 to Yoshida et al. which describes preparation of synthetic oils by reacting naphthalene and olefins with a Friedel-Crafts catalyst. U.S. Pat. No. 3,594,320 to Orkin describes upgrading a hydrocracked mineral oil either alone or admixed with a synthetic hydrocarbon fluid by treatment with an organic peroxide. U.S. Pat. No. 4,618,737 to Chester et al. describes preparation of synthetic oils by polymerizing olefins with a zeolite catalyst and, in a second stage, treating the resulting olefin oligomer with a ditertiary-alkyl peroxide. Other patents relating to the acid-catalyzed alkylation of aromatic hydrocarbons with olefins include U.S. Pat. No. 3,808,134; U.S. Pat. No. 4,148,834; and U.S. Pat. No. 4,658,072. The above-described patents all are incorporated herein by reference for background purposes.

One of the principle problems encountered with acid catalyzed alkylation of aromatic hydrocarbons is that, in general, the catalyst is not particularly selective, making it difficult to efficiently prepare only one specific aromatic derivative. For example, it is difficult to prepare a monoalkylbenzene in good single-pass yield without forming di- and higher alkylbenzenes. Also, it is difficult to form a specific dialkylbenzene isomer, since the catalyst has the ability to readily trans-alkylate and interconvert isomers.

It is an object of this invention to provide a novel synthetic alkylaromatic lube base stock. It is a further object of this invention to provide a synthetic hydrocarbon lube base stock having an exceptionally high V.I. It is still another object of this invention to provide a process for selectively manufacturing a tailored alkylaromatic hydrocarbon oil boiling above 600° F. and having an exceptionally high V.I. These and other objects will become apparent to one skilled in the art on reading this entire specification including appended claims.

SUMMARY OF THE INVENTION

We have now found that by a peroxide-induced addition reaction of a suitable olefin-substituted aromatic hydrocarbon with a monoolefinic aliphatic hydrocarbon, it is possible to directly form a synthetic lubricating oil having a low pour point and an unusually high V.I., all as more fully described hereinbelow.

SPECIFIC EMBODIMENTS

The olefin-substituted aromatic hydrocarbon useful in this invention is preferably a benzene or naphthalene derivative. The benzene or naphthalene moiety may have either one or two olefinic substituents, which substituents preferably are either vinyl groups, $CH_2{=}CH{-}$, or isopropenyl groups, $CH_2{=}C(CH_3){-}$.

A variety of aliphatic olefins may be reacted with the olefin-substituted aromatic to form the desired alkylaromatic hydrocarbon product. In general, alpha olefins having from about 6 to about 18 carbon atoms are useful. These include, as non-limiting examples, straight-chain olefins such as 1-decene, 1-dodecene, 1-hexadecene and oligomers thereof.

The oligomer reactant can be prepared from 1-butene, 1-hexene, 1-octene, 1-decene and 1-dodecene or a mixture of two or more of these 1-olefins, with 1-decene preferably being the predominant or only alpha-olefin reactant. Also, the oligomer reactant can be a mixture of oligomers prepared from different 1-olefins or from mixtures of 1-olefins.

The oligomerization reaction can be suitably effected with a boron trifluoride-containing catalyst in a manner well known in the art. Unreacted monomer and dimer are separated from the oligomer product mixture. In the case of 1-decene, the remainder is the trimer, tetramer, pentamer and generally a small amount of higher oligomers, primarily the hexamer, usually comprising no more than a few percent of this mixture. This oligomer mixture can be reacted with the aromatic compound without further separation or the trimer can be separated out by vacuum distillation and used separately. Due to difficulty in separation, the tetramer and pentamer of 1-decene are generally utilized as a mixture without separation. When the expression pentamer of 1-decene is used herein, it is to be understood that the term is intended to include the minor amount of hexamer and higher oligomers that may be present. Processes for oligomerizing an alpha-olefin to the oligomers, particularly the trimer, tetramer and pentamer, with a boron trifluoride catalyst are disclosed in U.S. Pat. Nos. 3,149,178; 3,382,291; 3,742,082; 3,763,244; 3,769,363; 3,780,128; and 3,997,621. These oligomer products can also be prepared with other catalysts such as a suitable aluminum trichloride catalyst as described in U.S. Pat. No. 3,842,134. The preparation of olefin oligomers per se is not part of the present invention.

Particularly preferred as the aliphatic olefin component are decene oligomers such as the trimer-tetramer fraction, for example.

The preferred free-radical coupling agent for purposes of the present invention is a ditertiary-alkyl peroxide. These peroxides can be represented by the formula, ROOR′, wherein R and R′ are like, or dissimilar, tertiary-alkyl radicals. In preferred practice the tertiary alkyl radicals are lower tertiary alkyl radicals. Non-limiting examples of the catalyst are ditertiary-butyl peroxide, ditertiary-amyl peroxide, and tertiary-butyl tertiary-amyl peroxide.

In general, the reaction mixture contains one to twenty moles of olefin per mole of olefin-substituted aromatic hydrocarbon, and preferably one to ten moles. To each 100 parts total of olefin plus olefin-substituted aromatic hydrocarbon is added about 0.5 to 30 parts, and preferably 1.0 to 20 parts of the ditertiary-alkyl peroxide. The amount of peroxide used affects the viscosity of the final product.

The reaction between the reactants to be coupled and the peroxide is carried out at elevated temperature, suitably at temperatures from about 50° C. to about 300° C. and in most cases from 100° C. to about 200° C. The treatment duration will normally be from about 1 hour to 6 hours but there is no fixed duration since various starting materials will vary in their reactivity and amenability to coupling by this method. The pressure employed will depend upon the temperature used and upon the reactants and, in most cases, needs to be sufficient only to maintain the reactants in the liquid phase during the course of the reaction. During the reaction, the peroxide is converted primarily to an alcohol by-product whose boiling point will depend upon the identity of the chosen peroxide. This alcohol by-product may be removed during the course of the reaction, or after its completion, by conventional means.

The 650° F. product produced by this invention may include very small amounts of olefins, and in order to improve the stability of the final lube product, it may be subjected to mild hydrogenation to saturate any lube range olefins. Treatment over a conventional hydrotreating catalyst such as Co/Mo on alumina at mild temperatures typically to 500° F. (260° C.) at relatively low hydrogen pressures, typically up to 1000 psig (7000 kPa) will normally be satisfactory.

EXAMPLES

This invention will now be illustrated by example. The examples, however, are not to be construed as limiting the scope of the invention, which scope is determined by this entire specification including the appended claims.

EXAMPLE 1

This example illustrates the synthesis of di-alkylbenzenes by coupling 1-decene with m-diisopropenyl benzene. A mixture of 1-decene, diisopropenyl benzene and ditertiary-butyl peroxide in the ratio 71.4/9.0/19.6 mole % was heated in an autoclave sealed with $N_2$ atmosphere at 200 psig pressure for 4 hours at 300° F. while stirring at 200 rpm. The product mixture was then purged with nitrogen to remove light products such as acetone and alcohol, and then distilled at 650° F. in order to obtain about 69 wt % yield of a lube fraction boiling above 650° F. The lube was then hydrogenated in a batch mode using Ni catalyst to saturate any olefins. Infra-red analysis of the sample indicates that the m-diisopropenyl benzene is readily coupled with 1-decene to form di-alkylbenzene lube base stock with the following properties:

| Pour Point, °F. | −25 |
|---|---|
| KV @ 40° C., cSt | 453.28 |
| @ 100° C., cSt | 37.19 |
| V.I. | 124 |

The di-alkylbenzene lube has a high V.I. and a low pour point. The viscosity of the lube can be adjusted by varying the amount of ditertiary-butyl peroxide.

EXAMPLE 2

In this example, the procedure described in Example 1 was used, but instead of 1-decene as in Example 1, the olefin source used in this example was a mixture of 1-decene oligomers consisting of trimer, tetramer and pentamer produced by a $BF_3$ polymerization process.

The feed consisted of 85 wt % decene oligomer, 10 wt % diisopropenyl benzene and 5 wt % ditertiary-butyl peroxide. The resulting synthetic lube oil had the following properties:

| Pour Point, °F. | −55 |
|---|---|
| KV @ 40° C., cSt | 53.50 |
| @ 100° C., cSt | 8.68 |
| V.I. | 139 |

The lube has a very low pour point and high V.I.

EXAMPLE 3

In this example, the procedure described in Example 1 was used, but in this example, the di-alkylbenzene lube was produced by reacting 1-hexadecene with m-diisopropenyl benzene. The feed mixture consisted of 90 wt % 1-hexadecene, 5 wt % m-diisopropenyl benzene and 5 wt % ditertiary-butyl peroxide (85.9/6.8/7.3 mole wt %). The resulted di-alkylbenzene lube has the following properties:

| Pour Point, °F. | 25 |
|---|---|
| KV @ 40° C., cSt | 246.0 |
| @ 100° C., cSt | 17.61 |
| V.I. | 147 |

EXAMPLE 4

This example illustrates the production of mono-alkylbenzene lube base stock by reacting styrene with the same decene oligomer as used in Examples 2. The feed consisted of 90 wt % decene oligomer, 5 wt % styrene and 5 wt % ditertiary-butyl peroxide. The resulted mono-alkylbenzene lube has the following properties:

| Pour Point, °F. | below −65 |
|---|---|
| KV @ 40° C., cSt | 55.42 |
| @ 100° C., cSt | 8.711 |
| V.I. | 133 |

EXAMPLE 5

In this example, instead of the decene oligomer used in Example 4, styrene is reacted with 1-decene with the following composition: 70 wt % 1-decene, 15 wt % styrene and 15 wt % ditertiary-butyl peroxide (67.0/19.3/13.7 mol %) to produce a mono-alkylbenzene lube.

| Pour Point, °F. | −30 |
|---|---|
| KV @ 40° C., cSt | 473.6 |
| @ 100° C., cSt | 37.32 |
| V.I. | 120 |

We claim:

1. A method for manufacturing a lube base stock oil, which method comprises:

preparing a mixture consisting of (a) an alkenylaromatic hydrocarbon having the formula

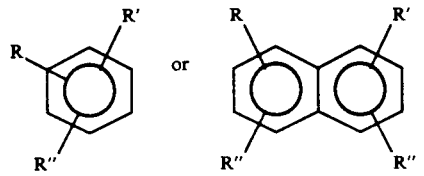

(I) (II)

wherein R is the $CH_2{=}CH{-}$ radical or the $CH_2{=}C(CH_3){-}$ radical and wherein R' is hydrogen or the $CH_2{=}CH{-}$ or the $CH_2{=}C(CH_3){-}$ radical and wherein R'' is individually selected from the group consisting of hydrogen and alkyl radicals having one to four carbon atoms; (b) from one to about 20 moles of an aliphatic olefin having at least about six to about forty carbon atoms per mole of alkenyl-aromatic hydrocarbon; and (c) about 0.5 to about 30 wt % of said mixture of alkenylaromatic hydrocarbon and aliphatic olefin of a ditertiaryalkyl peroxide;

maintaining said mixture at a temperature of 100° to about 200° C. for a time effective to decompose said peroxide whereby reacting said alkenylaromatic hydrocarbon with said aliphatic alpha olefin; and, recovering an alkylaromatic base stock oil boiling above about 600° F.

2. The method described in claim 1 including the step of hydrogenating said alkylaromatic base stock oil.

3. The method described in claim 2 wherein an alkenylbenzene hydrocarbon having the structure (I) is used and the ditertiary-alkyl peroxide is ditertiary-butyl peroxide.

4. The method described in claim 3 wherein said alkenylbenzene is diisopropenyl benzene and said aliphatic olefin is 1-decene.

5. The method described in claim 3 wherein said alkenylbenzene is diisopropenyl benzene and said aliphatic olefin is 1-hexadecene.

6. The method described in claim 3 wherein said alkenylbenzene is diisopropenyl benzene and said aliphatic olefin is an oligomer of 1-decene consisting of trimer and tetramer.

7. The method described in claim 3 wherein said alkenylbenzene hydrocarbon having the structure (I) is styrene.

8. The method described in claim 7 wherein said aliphatic alpha olefin is a linear olefin having 8 to 16 carbon atoms.

9. The method described in claim 7 wherein said aliphatic olefin is an oligomer of 1-decene consisting of trimer and tetramer.

10. The method described in claim 2 wherein an alkenylnaphthalene having the structure (II) is used, the ditertiary-alkyl peroxide is ditertiary-butyl peroxide, and the aliphatic olefin is selected from the group consisting of linear alpha olefins having 8 to 16 carbon atoms and oligomers of 1-decene.

11. The product produced by the method of claim 1.

12. The product produced by the method of claim 2.

13. The product produced by the method of claim 3.

14. The product produced by the method of claim 4.

15. The product produced by the method of claim 5.

16. The product produced by the method of claim 6.

17. The product produced by the method of claim 7.

18. The product produced by the method of claim 8.

19. The product produced by the method of claim 9.

20. The product produced by the method of claim 10.

* * * * *